US010138658B2

(12) United States Patent
Barton et al.

(10) Patent No.: US 10,138,658 B2
(45) Date of Patent: Nov. 27, 2018

(54) THREE POINT LOCK

(71) Applicant: Milgard Manufacturing Incorporated, Tacoma, WA (US)

(72) Inventors: Michael A. Barton, Orting, WA (US); Travis James Dodge, Olympia, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 251 days.

(21) Appl. No.: 15/173,107

(22) Filed: Jun. 3, 2016

(65) Prior Publication Data

US 2017/0350174 A1 Dec. 7, 2017

(51) Int. Cl.

| | |
|---|---|
| ***E05B 55/00*** | (2006.01) |
| ***E05C 1/12*** | (2006.01) |
| ***E05B 63/20*** | (2006.01) |
| ***E05B 65/08*** | (2006.01) |
| ***E05C 7/00*** | (2006.01) |
| ***E05C 9/04*** | (2006.01) |
| ***E06B 3/44*** | (2006.01) |

(52) U.S. Cl.

CPC ..... *E05C 1/12* (2013.01); *E05B 63/20* (2013.01); *E05B 65/087* (2013.01); *E05B 65/0864* (2013.01); *E05C 7/00* (2013.01); *E05C 9/042* (2013.01); *E06B 3/4415* (2013.01); *E05C 2007/007* (2013.01)

(58) Field of Classification Search

CPC .... E05B 63/20; E05B 65/087; E05B 65/0864; E05B 63/12; E05C 9/042; E05C 1/10; E05C 1/12; E05C 7/00; E05C 2007/007; E06B 3/4415; E05D 15/22

USPC .... 49/449, 506; 292/32, 138, 177, 137, 163, 292/165, 167, 173; 70/90

See application file for complete search history.

(56) References Cited

U.S. PATENT DOCUMENTS

| | | | | |
|---|---|---|---|---|
| 632,140 | A | 8/1899 | Parker et al. | |
| 907,493 | A | 12/1908 | Gunther | |
| 952,516 | A | 3/1910 | Fogarty | |
| 2,737,045 | A | 3/1956 | Holmsten | |
| 3,481,077 | A * | 12/1969 | Grossman | E06B 3/50 49/188 |
| 3,668,906 | A | 6/1972 | Josephart | |
| 5,829,196 | A * | 11/1998 | Maier | E05D 13/08 49/181 |
| 7,676,990 | B2 * | 3/2010 | Bestler | 292/169 |
| 8,182,001 | B2 | 5/2012 | Tremble et al. | |
| 8,205,920 | B2 | 6/2012 | Flory | |
| 8,899,632 | B2 | 12/2014 | Tremble et al. | |
| 8,978,304 | B2 * | 3/2015 | Hollermann | E05B 53/003 49/176 |
| 9,341,006 | B1 * | 5/2016 | Lawrence | E05C 3/046 |
| 9,556,652 | B2 * | 1/2017 | Lund | E05B 65/08 |

(Continued)

*Primary Examiner* — Chi Q Nguyen

(74) *Attorney, Agent, or Firm* — Rathe Lindenbaum LLP

(57) ABSTRACT

A fenestration assembly includes a frame assembly, a movable sash assembly and a lock assembly. The lock assembly includes a first lock and a second side lock. The first lock operatively locks and unlocks the moveable sash to the frame assembly in a first direction only when the movable sash is in a fully closed position. The first side lock operatively locks and unlocks the movable sash in a second direction perpendicular to the first direction both when the movable sash is in the fully closed position and a partially open position.

16 Claims, 8 Drawing Sheets

(56) References Cited

U.S. PATENT DOCUMENTS

| | | | | |
|---|---|---|---|---|
| 9,657,503 | B2 * | 5/2017 | Hollermann | E05B 53/003 |
| 2010/0037524 | A1 * | 2/2010 | Liang | E05B 63/12 49/176 |
| 2011/0107672 | A1 * | 5/2011 | Curtis | E05B 1/0038 49/130 |
| 2013/0125471 | A1 * | 5/2013 | Benevenga | E05B 65/0841 49/449 |
| 2015/0275556 | A1 * | 10/2015 | Curtis | E06B 3/4415 49/449 |

* cited by examiner

THREE POINT LOCK

CROSS-REFERENCE TO RELATED PATENT APPLICATIONS

None.

BACKGROUND

The present invention relates generally to the field of fenestration assemblies and more particularly to a three point lock for a fenestration assembly.

SUMMARY

A fenestration assembly includes a window frame and a movable sash movable from a fully closed to a partially open position. A handle moves between a first position and a second position, a first lock being moved from a locked position to an unlocked position when the handle is moved from the first position to the second position. A first side lock being movable an unlocked position to a locked position when the movable sash is in a partially open position and the handle is moved from the second position to the first position while maintaining the first lock in its unlocked position.

DETAILED DESCRIPTION OF THE EXAMPLE EMBODIMENTS

Figure 1:
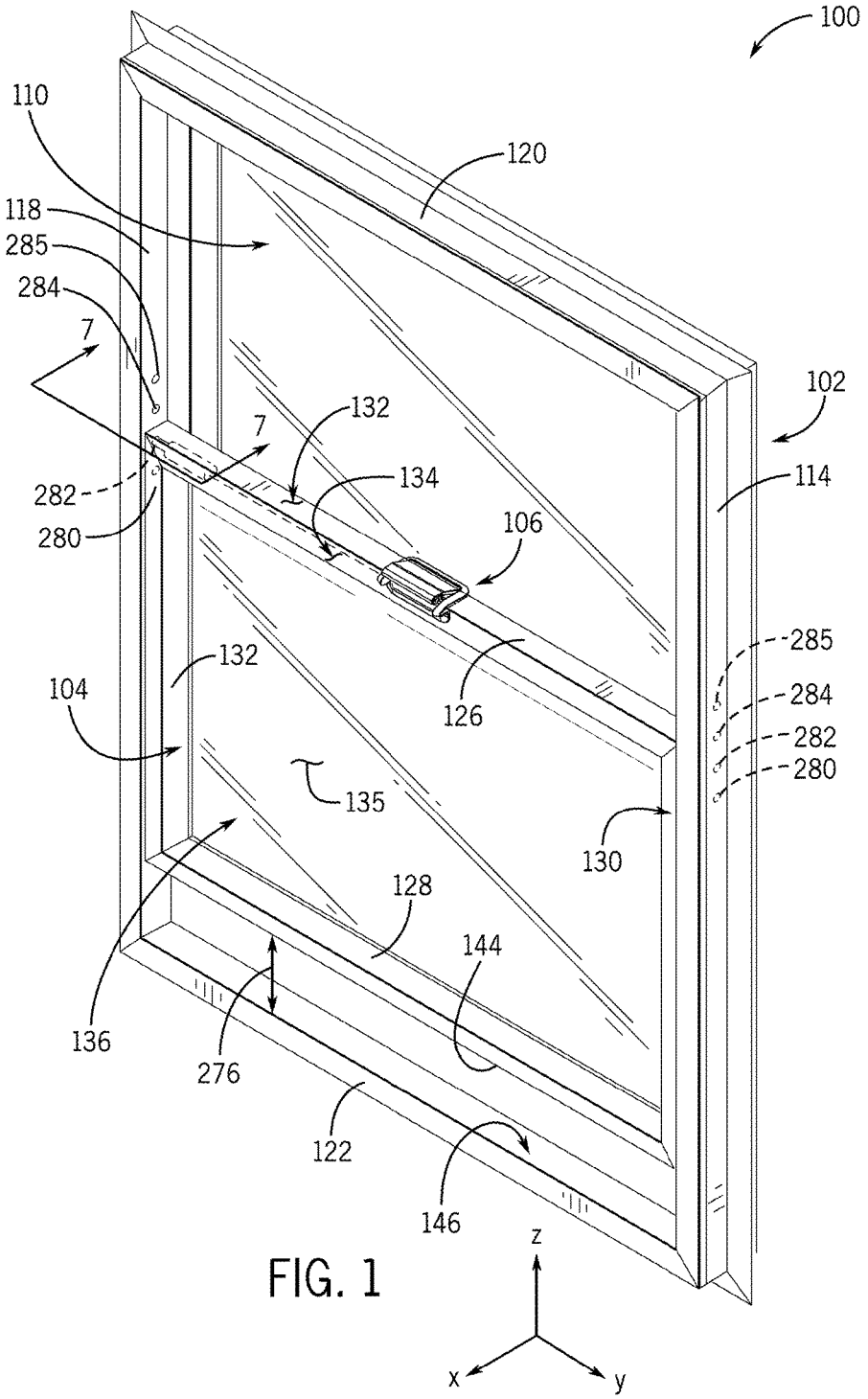
FIG. 1 is an isometric view of a fenestration assembly.
Figure 2:
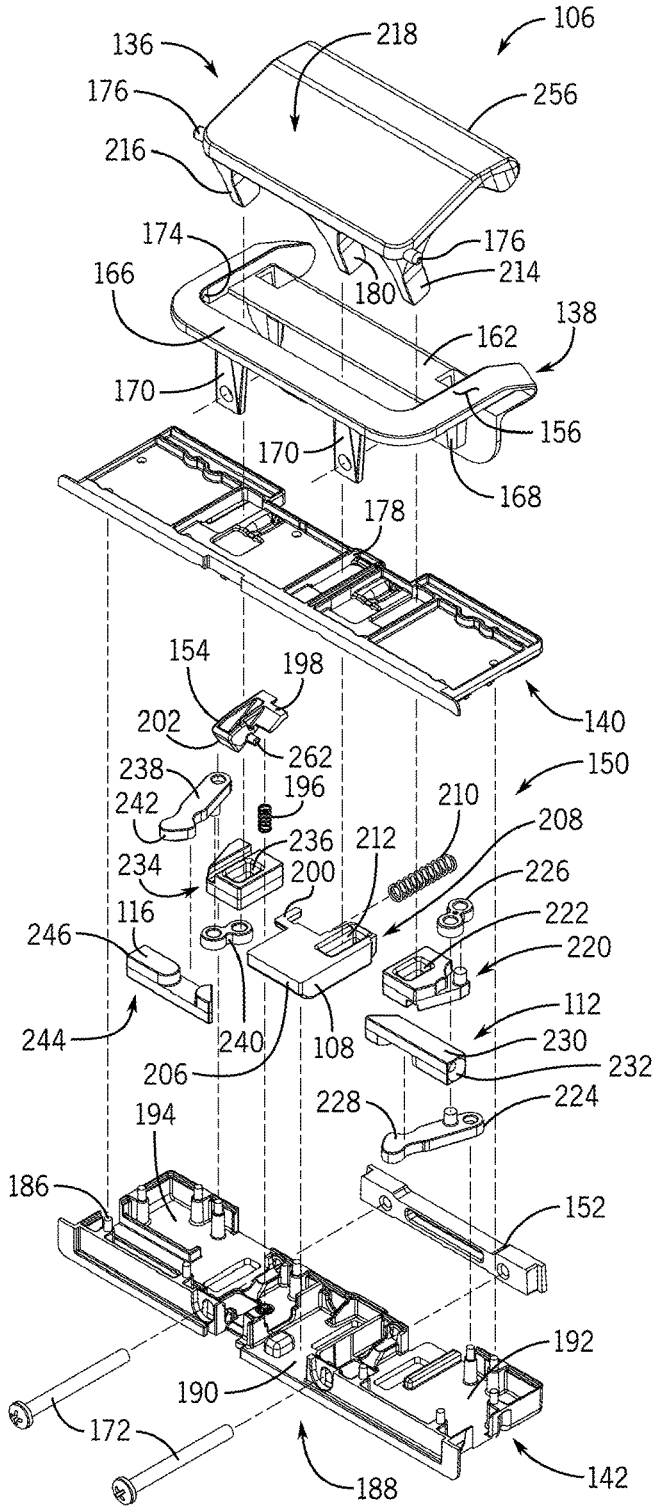
FIG. 2 is an isometric exploded view of the three point lock assembly taken from an outside view.

Referring to FIG. 1 and FIG. 2 a fenestration assembly 100 includes a frame or frame assembly 102 for an architectural element 104 for a door or window in an opening of an architectural structure such as building. In one embodiment architectural element 104 is movably secured to frame 102 with a lock assembly 106. Architectural element 104 may be a movable window sash, a door or other type of fenestration structure. Lock 106 assembly is operatively connected to movable sash 104 to lock movable window sash 104 to frame 102 and a fixed sash 110 with three different engagement members.

To provide an orientation for discussion, the term outwardly direction will refer to the direction that faces away from the building structure that supports the fenestration assembly with a vector having a direction from the inside of the building structure toward the outside of the building structure and generally perpendicular to the direction of gravity. If a user is standing outside of a building and looking at the fenestration assembly the user would see the outwardly facing surfaces of the fenestration assembly. Similarly, if a person is standing inside of a building structure and looking at the fenestration assembly the user would see the inwardly facing surfaces of the fenestration assembly.

Unless otherwise indicated, the directions used herein reflect the orientation of a user facing the fenestration assembly from the interior of an enclosure or building structure. Inwardly includes the direction away from the window towards the user and the interior of an enclosure. The direction up and down includes the direction away from and toward the direction of gravity respectively. The left and right directions include the directions as viewed by a user facing the window or fenestration assembly from the interior of an enclosure. The term front will include the surfaces facing the interior of the enclosure while the term back will include the surfaces or regions facing away from the interior of the enclosure.

Referring to FIG. 2 lock assembly 106 includes a main lock member 108 that operatively secures sash 104 to second movable or fixed sash 110. Lock assembly 106 further includes a first or right lock side member 112 that is removably engaged with a first or right jamb member 114 of frame assembly 102. Similarly lock assembly 106 includes a second or left lock side member 116 that is removably engaged with a second or left jamb member 118. The operation of the main lock 108, first side lock 112 and second side lock 116 will be described herein.

Referring to FIG. 1 movable sash 104 includes a first rail 126 and a second rail 128 spaced from first rail 126. The first rail 126 has a first longitudinal axis that is parallel to a second longitudinal axis of the second rail 128. In one embodiment first rail 126 is an upper rail and second rail 128 is a lower rail. Movable sash 104 further includes a first stile 130 and a second stile 132 spaced from first stile 130. In one embodiment first stile 130 is a right stile and second stile 132 is a left stile. First rail 126 includes an upper surface 132 that defines a plane that is generally perpendicular to a plane defined by glazing 135. First rail 126 further includes a front surface 134 that defines a plane generally parallel to the plane defined by glazing 135 and perpendicular to the plane defined by upper surface 132.

Frame assembly 102 includes a first jamb 114 and a second jamb 118 that is spaced from the first jamb 114. In one embodiment a longitudinal axis of first jamb 114 is parallel to a longitudinal axis of second jamb 118. In one embodiment the longitudinal axes of the first jamb and second jamb are parallel to the longitudinal axes of stile members 130 and 132 of movable sash 104. Frame assembly 102 includes a first frame member or header 120 and a second frame member or sill 122. First frame member 120 is spaced from second frame member 122. First frame member 120 has a first frame member longitudinal axis that is parallel to a second frame member longitudinal axis of the second frame member 122. First frame member longitudinal axis and the second frame member longitudinal axis are perpendicular to the longitudinal axes of the first jamb 114 and second jamb 118.

The term longitudinal axis as used herein includes a line that extends generally along the length of the member as opposed to its width, where the length is greater than the width. For example the longitudinal axis of stile 130 extends along the z-axis of the Cartesian coordinate system as illustrated in FIG. 1. Similarly the longitudinal axis of rail 128 extends along or generally parallel to the y-axis of the Cartesian coordinate system in FIG. 1.

Figure 3:
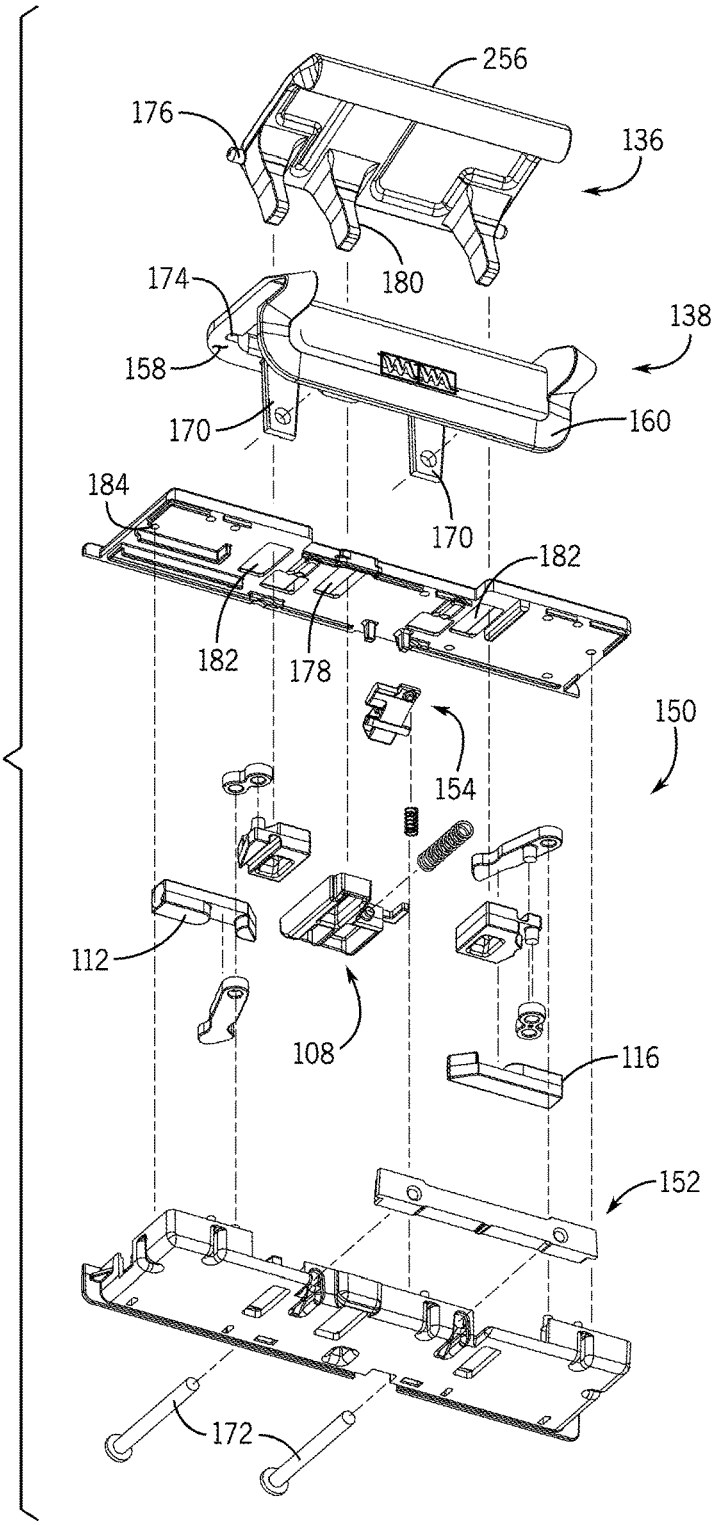
FIG. 3 is an isometric exploded view of the three point lock assembly taken generally from an inside view.

Referring to FIGS. 2 and 3 lock mechanism includes a handle 136, a bezel 138 an upper housing member 140 and a lower housing member 142. Upper housing member 140 and lower housing member 142 are positioned within a recess or channel of first rail 126.

To assist in the discussion movable sash 104 is moved from a fully closed position in which a bottom surface 144 of second rail 128 is adjacent an upper surface 146 of sill or second frame member 122 to a partially open position in which bottom surface 144 is spaced from upper surface 146 a distance greater than zero inches. In a fully open position movable sash 104 is positioned such that the distance 276 between bottom surface 144 and upper surface 146 is a maximum distance. In the fully opened position the upper surface 132 of first rail 126 can be positioned no closer to top rail 120. Stated another way when movable sash 104 is in a fully opened position the distance between upper surface 132 of first rail 126 and header 120 is at a value that is less than the distance between upper surface 132 and header 120 when the movable sash 104 is in a partially opened position.

As noted above lock assembly 106 includes three separate locks. First or main lock 108 is movable and extends from an unlocked retraced position within housing members 140 and 142 in a direction away from second sash 110 toward a locked position in which a portion of first main lock 108 is operatively received within second sash 110 to prevent movement of movable sash 104 relative to second sash 110. Side locks 112 and 116 extend from an unlocked position in which side locks move toward first lock 108 to a locked position in which a portion of side locks 112 and 116 are operatively engaged with first jamb 130 and second jamb 132 to operatively prevent movement of the movable sash 104 relative to frame assembly 102.

Figure 9:
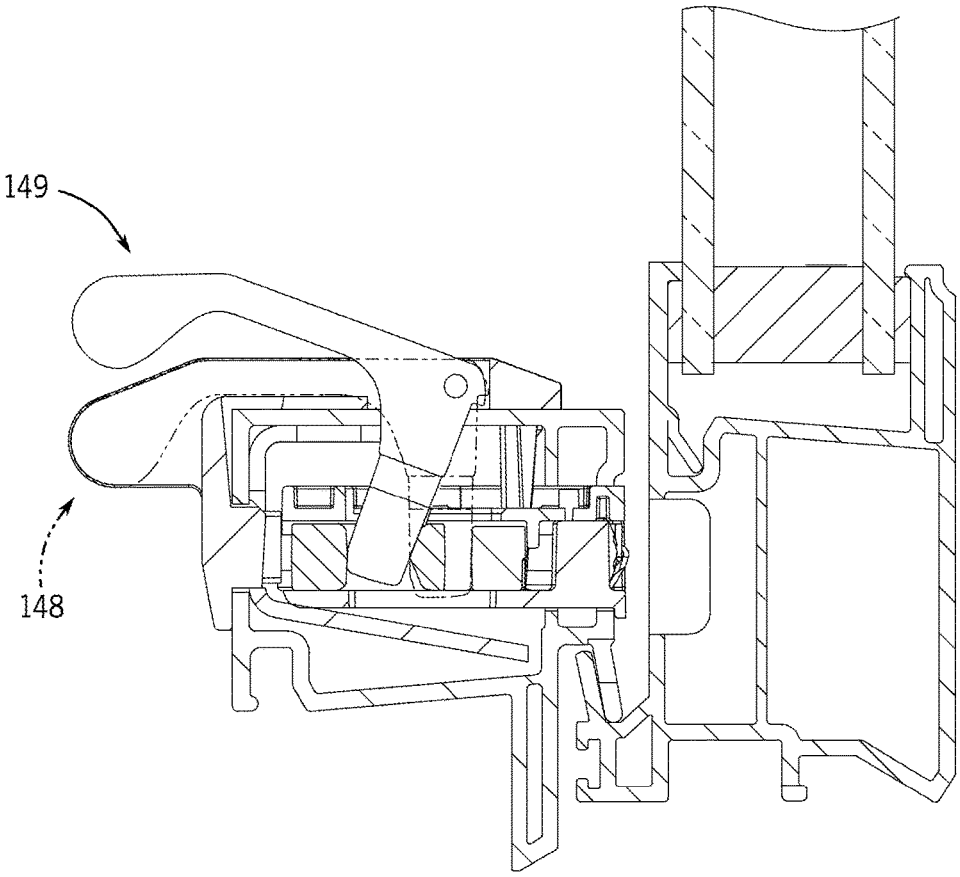
FIG. 9 is a cross-sectional view showing the handle in a first position and a second position.

Referring to FIG. 9 handle 136 moves from a first position 148 to a second position 149. In one embodiment a majority of first handle 136 is closer to second rail 128 in the first position than the second position. In one embodiment first position 148 is a lowered position and second position is a raised position. When movable sash 104 is the fully closed position and handle 136 is in the first position main lock 108 is in the locked position and first side lock 112 and second side lock 116 are in the locked positions. When handle 136 is moved from the first position 148 to the second position 149 main lock 108, first side lock 112 and second side lock 116 move to their respective unlocked positions. In one embodiment if movable sash 104 remains in the fully closed position and a user moves handle 136 from the first position to the second position and then allows handle 136 to move back to the first position then main lock 108, first side lock 112 and second side lock 116 will all move back to their respective locked positions.

Once the main lock 108, first side lock 112 and second side lock 116 are in their respective unlocked positions it is possible to move movable sash 104 from its fully closed position to a partially open position. In one embodiment a stop 154 as described herein maintains main lock 108 in the unlocked position when handle 136 is in the second position and movable sash 104 is in a partially open position. When a user releases handle 136 when movable sash 104 is in the partially open position handle 136 will remain in the second position until either a user moves handle 136 to the first position or movable sash is moved to the fully closed position. As explained below a biasing element 210 retains handle 136 in the second position when handle 136 is released by a user when movable sash 104 is in the partially open position.

In the partially open position movement of handle 136 from the second position toward the first position will operatively move first side lock 112 and second side lock 116 toward their respective locked positions while maintaining the main lock 108 in its unlocked position. As a result moveable sash 104 is in a partially raised position with both side locks 112, 116 being in the locked position while main lock 108 remains in an unlocked position.

When movable sash 104 is in the partially open position and handle 136 is subsequently moved from the first position to the second position first side lock 112 and second side lock 116 will move from their respective locked position to their respective unlocked position. In this orientation main lock 108, first side lock 112 and second side lock 116 are all in their unlocked position.

A user may move movable sash 104 from the partially open position to a fully closed position and as described herein once movable sash 104 is in the fully closed position, main lock 108, first side lock 112 and second side lock 116 are all automatically moved from their respective unlocked to their respective locked positions thereby locking movable sash to the frame at three distinct locations. The term automatically here is means that handle 136 moves to its first position, main lock 108, side lock 112 and second side lock 116 all move to their locked position without a user physically touching handle 136. As discussed herein as movable sash 104 is moved to the fully closed position stop 134 is released from main lock 108 and 210 spring biases main lock 108 toward its locked position which in turn moves handle 136 to the handle first position and moves first side lock 112 and second side lock 116 to their respective locked positions.

Referring to FIGS. 2 and 3, a latch mechanism 150 operatively connects handle 136 to main lock 108, first side lock 112 and second side lock 116. Main lock 108 is removably inserted into striker plate or latch plate operatively secured to a rail of a second sash 110 and includes a recessed area or aperture 154 configured to receive a free end of main lock 108. Handle 136 is pivotally attached to a handle faceplate or bezel 138. Main lock 108, first side lock 112 and second side lock 116 are slidably positioned between upper housing member 140 and lower housing 142 and movable between a first extended locked position to a second retracted unlocked position. A lockout stop 154 is pivotally attached to lower housing member 142 to retain main lock 108 in a retracted position unlocked position when handle 136 is moved to the second position and movable sash 104 is in the partially open position.

Referring to FIG. 1 first rail 126 includes a top surface 132, a first downwardly extending portion 134. A ledge (not shown) may extend between top surface 132 and beyond downwardly extending surface 134. The ledge provides a user with an area to grab first rail 126 when movable sash 104 is being moved relative to second sash 110. A ledge is shown in U.S. Pat. No. 8,182,001 and incorporated herein by reference in its entirety.

Referring to FIG. 2 and FIG. 3 bezel frame 138 includes a top surface 156 and an opposing bottom surface 158 that contacts the top surface 132 of first rail 126. Bezel frame 138 also includes a downwardly extending portion 160 that contacts and covers a portion of downwardly extending portion 134 of first rail 126; a top land region 162 generally perpendicular to downwardly extending portion 160; and a rear portion 166 generally opposite of downwardly extending portion 160. Downwardly extending portion 160 has coupling features, shown as two generally L-shaped brackets or flanges 168 that are configured to receive a fastener bar 152. Bezel frame 138 further includes two tabs or flanges 170 that extend downward from bottom surface 158 that are configured to receive fasteners 172 in apertures formed in each respective tab 170. Bezel frame 138 further includes two apertures, recesses or bearings 174 proximate a rear portion 166 of bezel frame 138 to receive two pivots 176 of handle 136.

Referring to FIG. 2 and FIG. 3 upper housing 140 is secured to lower housing 142 with fasteners (not shown). Upper housing 140 includes an aperture 178 through which a first arm 180 of handle 136 extends and two apertures 182 through which flange 214 and flange 216 respectively extends. Upper housing 140 further includes a plurality of apertures 184 (e.g., depressions, holes, hollows, sockets, etc.) that extend partially or completely through upper housing 140 and are configures to receive posts 186 on lower housing 142.

Lower housing 142 includes a bottom panel 188 having a first region 190, a second region 192 and a third region 194. Main lock 108 slidably moves within first region 190 from an unlocked position to a locked position. First side lock 112 moves within second region 192 from an unlocked position to a locked position. Second side lock 116 moves within third region 194 from an unlocked position to a locked position. Stop member 154 is positioned in a region intermediate first region 190 and third region 194. A biasing member 196 biases stop member into an engaged position in which main lock 108 is held in an unlocked position until stop member 154 is moved from the engaged position to a disengaged position. Stop member 154 includes a flange member 198 that contacts an extending member 200 on main lock 108. Stop member 154 includes a contact portion 202 that contacts a striker plate secured to or part of second sash 110. Stop member 154 includes a pivot 262 that is received within an opening in lower housing 142.

Main lock 108 includes a leading end portion 206 and trailing end portion 208. A biasing member 210 operatively biases main lock 108 from the unlocked position to the locked position. Main lock 108 includes an aperture or channel 212 proximate trailing end portion 208 and receives a free end of first arm 180. Handle 136 includes a second arm 214 and a third arm 216 that extend in a direction generally perpendicular to a plane defined by a first surface 218 of handle 136 such that the free terminal ends of second arm 214 and third arm 216 are further from surface 218 than other portions of second arm 214 and third arm 218 respectively.

First side lock 112 is operatively connected to handle 136 with a first linkage member 220 having an aperture and/or cavity 222 that receives free end of second arm 214 therein. A first side lock arm member 224 is operatively coupled to first linkage member 220 with a link 226. First side lock arm member 224 includes an engagement surface 228 that moves first side lock 112 between a locked position and an unlocked position. In one embodiment first side lock 112 includes a first member 230 having an aperture 232 that received an elongated member 286 that is removable received within an aperture in frame 102.

Similarly second side lock 116 is operatively connected to handle 136 with a second linkage member 234 having an aperture and/or cavity 236 that receives free end of third arm 216 therein. A second side lock arm member 238 is operatively coupled to second linkage member 234 with a link 240. Second side lock arm member 238 includes an engagement surface 242 that moves second side lock 116 between a locked position and an unlocked position. In one embodiment second side lock 116 includes a first member 244 having an aperture 246 that receives an elongated member 290 that is removable received within an aperture in frame assembly 102.

Engagement surfaces 228 and 242 have a cam surface that operatively engages an arcuate or cam surface 248 and 250 respectively on first side lock 112 and second side lock 116 respectively. First side lock 112 includes a region that receives/interacts with engagement surface 228. A trailing end of first side lock 112 includes a portion 252 that receives a portion 256 of cam surface 228. Similarly a trialing end of second side lock 116 includes a portion 254 that that receives/interacts with a portion 258 of cam surface 242.

Figure 4A:
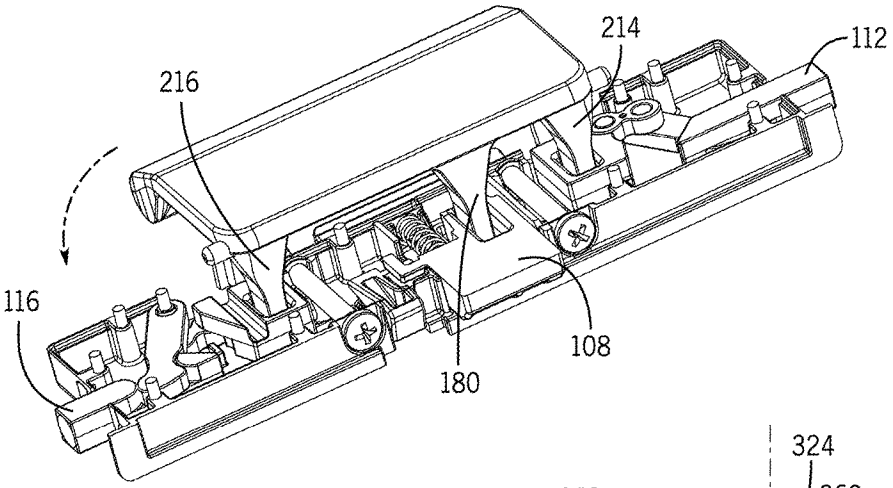
FIG. 4A is a partial isometric view of the three point lock being moved to a three point locked position.
Figure 4B:
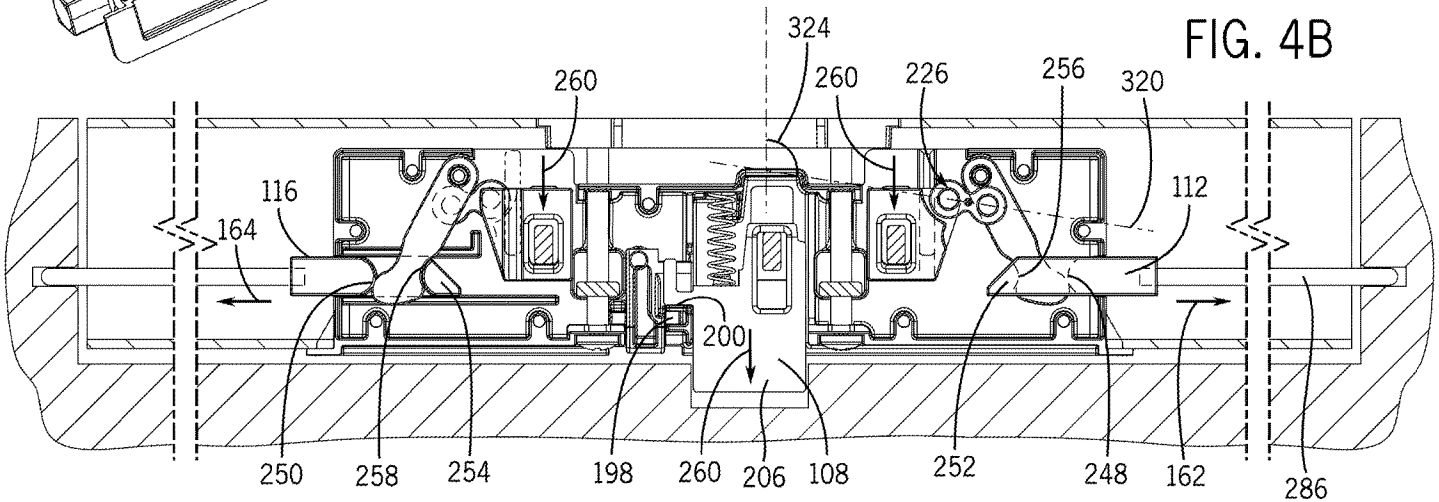
FIG. 4B is a cross-sectional view of the three point lock being moved to a three point locked position.

Referring to FIGS. 4A and 4B main lock 108, first side lock 112 and second side lock 116 are moved from the unlocked positions to their respective locked positions by movement of handle 136 from the second position to the first position. As described below when movable sash 104 is in the fully closed position and main lock, first side lock 112 and second side lock 116 are in their respective locked positions, movable sash 104 is locked to second sash 110 in one location and locked to frame 104 in two separate locations.

Referring to FIGS. 2 and 4A when movable sash 104 is in the fully closed position, as handle 136 moves from the second position to the first position the free end of first arm 180, the free end of second arm 214 and the free end of third arm 216 operatively move main lock 108, first side lock 112 and second side lock 116 from their respective unlocked position to their respective locked positions.

As handle 136 moves from the second position to the first position by pivoting about pivots 176, a free end 256 of handle moves closer to second rail 128 and the free ends of first arm 180, second arm 214 and third arm 216 move in a direction having a vector component that is perpendicular to a plane defined by the glazing of sash 110 in a direction toward the glazing of sash 110. As a result main lock 108 is moved from the unlocked position to the locked position and first side lock 112 and second side lock 116 are moved from their respective unlocked positions to their respective locked positions.

As handle is moved from the second position to the first position in addition to movement of first arm 180 of handle 136, second arm 214 of handle 136 moves in a manner to bias first linkage member 220 in direction 260 and moves first side lock 112 in a direction 162 through link 226 and first side lock arm member 224. As a result first side lock 112 is moved from the unlocked to locked orientation. Similarly and simultaneously with the movement of main lock 108 and first side lock 112, third arm 216 biases second linkage member 234 in direction 260 and moves second side lock 116 in direction 164 via linkage 240 and first side lock arm member 238. As a result second side lock 116 is moved from the unlocked position to the locked position in direction. In one embodiment direction 164 is directly opposite direction 162 and directions 164 and 162 are perpendicular to direction 260.

Figure 5A:
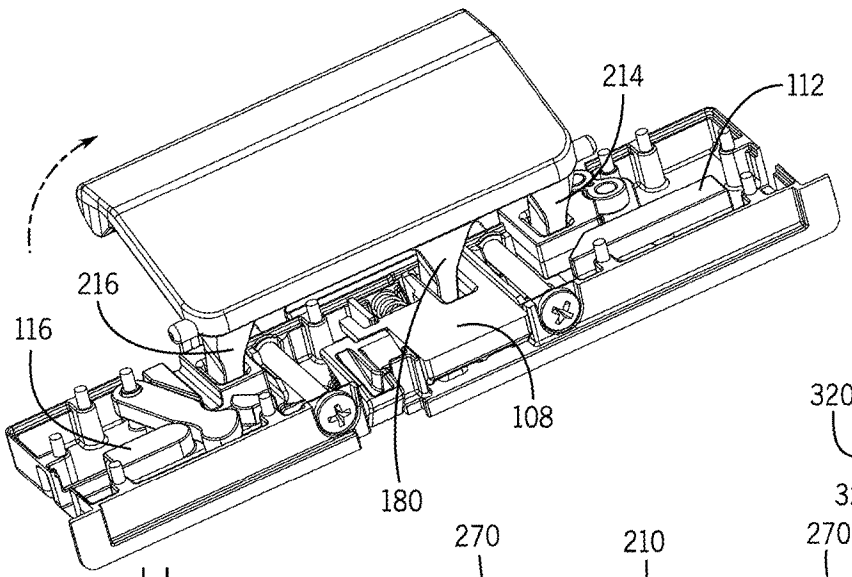
FIG. 5A is a partial isometric view of the three point lock being moved to a three point un-locked position.
Figure 5B:
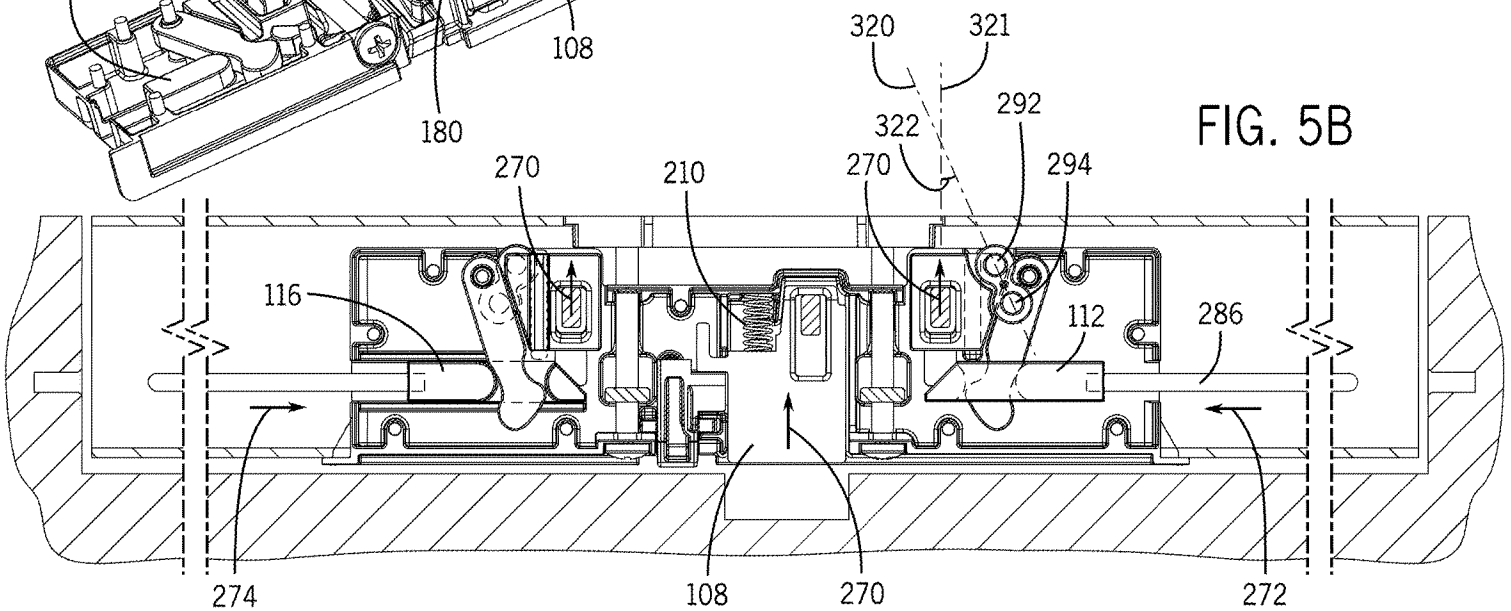
FIG. 5B is a cross-sectional view of the three point lock being moved to a three point un-locked position.
Figure 6A:
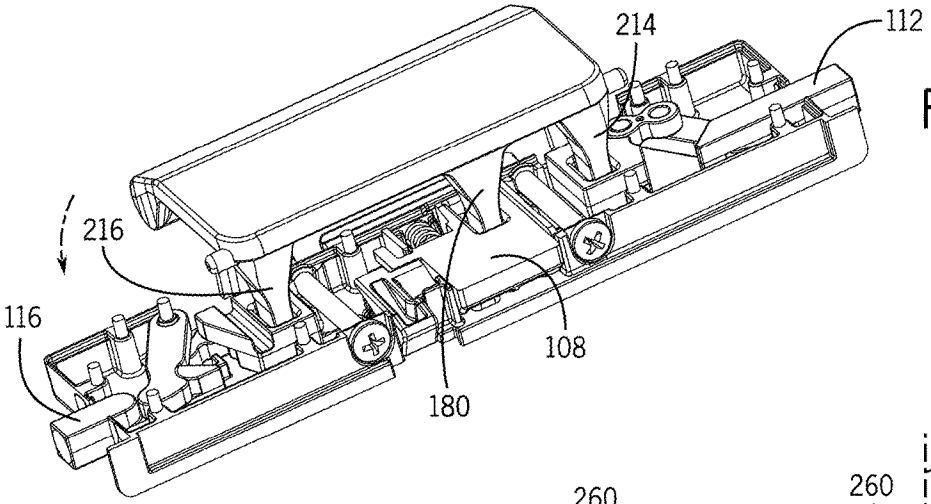
FIG. 6A is a partial isometric view of the three point lock being moved to a two point locked position.
Figure 6B:
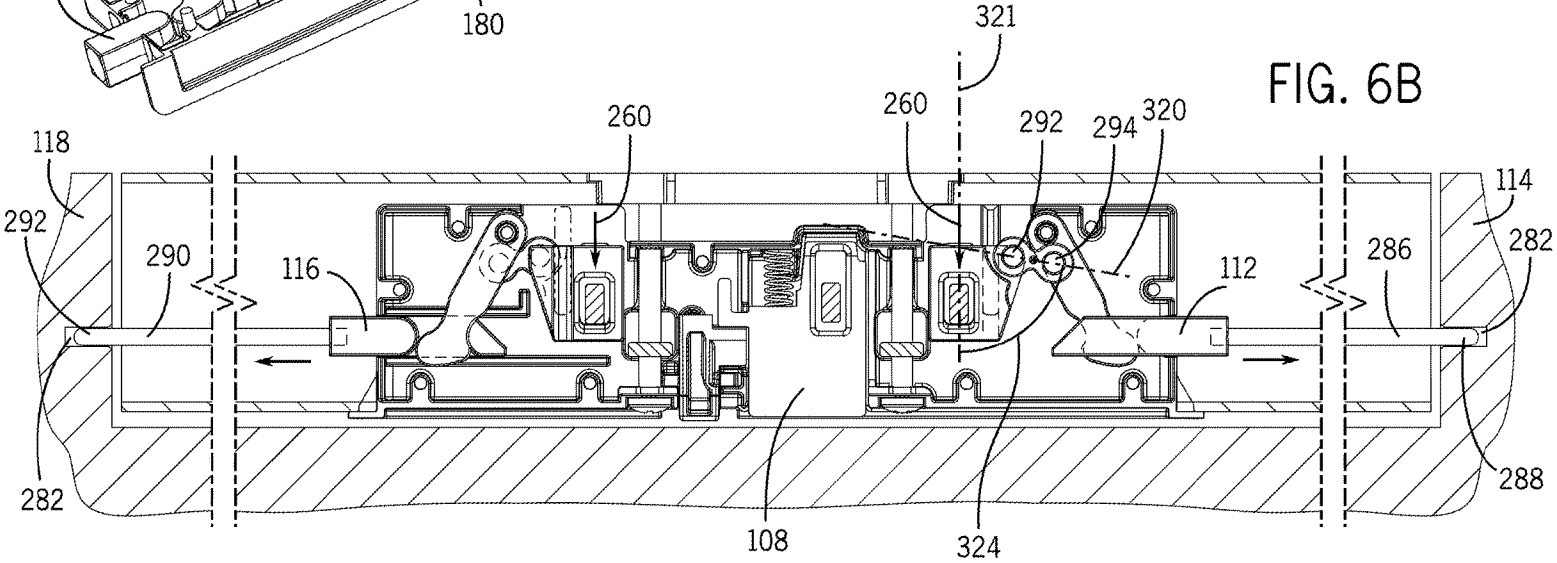
FIG. 6B is a partial top view of the three point lock being moved to a two point locked position.

Referring to FIG. 5B and FIG. 6B the location of the linkage components in the linkage chain for first side lock 112 and second side lock 116 between the unlocked position (FIG. 5B) and locked position (6B) are illustrated. Links 226 and 240 are positioned within the first and second side lock linkage chain respectively to provide an over center geometry that resists movement of first and secondary locks 112, 116 from their respective locked position to their unlocked positions. Referring to FIG. 5B when first side lock 112 is in the unlocked position a longitudinal axis 320 of link 226 forms a first angle 322 with respect to a line 321 including vector 270. When first side lock 112 is in the locked position the longitudinal axis 320 of link 226 forms a second angle 324 with respect to a line 321 including a longitudinal axis co-linear or parallel with vector 260. Where the second angle 324 is greater than the first angle 322. The second angle 324 is designed to be sufficient to prohibit first side lock 112 from moving from the locked position to unlocked position by an application of force along vector 272.

In one embodiment link 226 has a generally dog bone shape defining a longitudinal axis 320 through the center of members 292 and 294. First angle 322 and second angle 324 are defined as the angle between longitudinal axis 320 and a longitudinal axis that includes vector 260 and vector 270.

As described in more detail below stop member 154 which acts to retain main lock 108 in the unlocked position when the movable sash 104 is in the partially raised position also acts as the trigger to automatically move handle 136 from the second position to the first position when movable sash 104 is moved to the fully closed position.

Stop member 154 acts to retain main lock 108 in the retracted position as handle 136 is moved from the first position to the second position. Main lock 108 is moved from the locked position to the unlocked position as handle 136 is moved from the first position to the second position. Stop member 154 pivots about pivot 262 by biasing member 196 until contact portion 202 extends out of lower housing 142 in a direction toward second sash 110. Stop member 154 prohibits main lock 108 from moving from the unlocked position to its locked position by engagement of flange member 198 of stop member 154 with extending member 200 of main lock 108.

As movable sash 104 is moved from the partially open position to the fully closed position a contact portion 202 of stop 154 contacts a portion of the striker plate on second sash 110 and results in stop 154 pivoting to the disengaged position thereby releasing extending member 200 of main lock 108. Biasing member 210 then biases main lock 108 from the unlocked position to the locked position. As main lock 108 moves from the unlocked position to the locked position handle 136 via arm 180 automatically is moved from the second position to the first position and simultaneously arms 214 and 216 are moved thereby moving first side lock 112 and second side lock 116 to their respective locked positions.

Referring to FIGS. 5A and 5B when movable sash 104 is in the fully closed position and main lock 108, first side lock 112 and second side lock 116 are in their locked positions a user unlocks movable sash 104 relative to second sash 110 and frame 102 a by moving handle 136 from the first position to the second position. As handle 136 is moved from the first position to the second position free ends of arms 180, 214 and 216 are moved in a direction away from second sash 110. As the free end of arm 180 is moved away from second sash 110 in a direction perpendicular to a plane defined by the glazing of the second sash 110 the free end of arm 180 or a region proximate the free end of arm 180 contacts a wall that defines opening 212 in main lock 108 and moves main lock from its locked position to its unlocked position. Stop 154 then prohibits main lock 108 from moving back to the locked position once movable sash 104 is in a partially open position. Simultaneously with movement of the free end of first arm 180 the free ends of second arm 214 and third arm 216 contact a respective wall defining apertures 222 and 236 of first linkage members 220 and 234 respectively thereby biasing second first linkage member 220 and second linkage member 234 in a direction 270 and through the linkage chains defined herein moves first side lock 112 and second side lock 116 from their respective locked to unlocked positions along vectors 272 and 274 respectively.

Referring to FIGS. 6A and 6B the operation of lock assembly 106 in the partially open will be described. Once a user moves handle 136 from the first position to the second position and moves movable sash 104 from the fully closed position to a partially open position main lock 108, first side lock 112 and second side lock 116 are in their respective unlocked positions. To allow air to circulate between second rail 128 of movable sash 104 and sill member 122 and still prevent entry into the structure first side lock 112 and second side lock 116 are moved to their respective locked positions. However when the movable sash is in the partially open position main lock 108 is maintained in its unlocked position. Keeping main lock 108 in its unlocked position until movable sash 104 is in its fully closed position minimizes the changes that main lock 108 will damage part of second sash 110. It may be desirable to lock movable sash 104 relative to frame 102 so that movable sash may not be moved to a fully open position. A partially open orientation of movable sash 104 relative to second sash 110 may be desirable to allow air to enter through the fenestration assembly without allowing a person to enter through the fenestration assembly. In one embodiment a partially open position includes a first partially open position where there is a gap 276 between second rail 128 and a top surface 146 of sill 122. When movable sash 104 is in the fully closed position there is no gap 276 between rail 128 and sill 122. Stated another way when movable sash 104 is in the fully closed position no air may flow between second rail 128 and sill 122 in a direction perpendicular to the plane defined by glazing 135. In one embodiment it is possible to lock movable sash 104 relative to frame 102 in more than one partially open position. To minimize unauthorized entry into the structure through fenestration assembly 100 gap 276 is kept to a few inches as is understood in the art.

Referring to FIG. 1 frame 102 includes a plurality of pairs of apertures 280, 282, 284 and 285. First pair of apertures 280 are positioned within frame 102 to receive a free end 288 of first side lock extension 286 and a free end 292 of second side lock extension 290 when first side lock 112 and second side lock 116 are moved to the locked position when movable sash is in the fully closed position.

Additional pairs of apertures 280, 282 and 285 are positioned within frame 102 to receive a free end 288 of first side lock extension 286 and a free end 292 of second side lock extension 290 when first side lock 112 and second side lock 116 are moved to the locked position when movable sash is in a first partially open position. As used herein the term partially open position refers to any position between a fully closed position and a fully open position of movable sash relative to second sash 110. Stated another way it is possible for the movable sash in the partially open position to be more than one position so long as the movable sash 104 is not in the fully closed position or the fully open position.

Accordingly, referring to FIG. 1 first side lock 112 and second side lock 116 may be locked within each of the pairs of apertures 280, 282, 284 and 285. With gap 276 being the smallest distance when first side lock 112 and second side lock 116 are in a locked position such that free end 288 and 292 are within apertures 280 and gap 276 being progressively greater distance when free ends 288 and 292 are in apertures 282, 284 and 285 respectively. In a first partially open position gap 276 is greater than 0 inches and in the second partially open position gap 276 is greater than the gap in the first partially open position. Although three four of apertures are illustrated in FIG. 1 in one embodiment there are less than four pairs of apertures and in one embodiment there are more than four pairs of apertures.

In one embodiment the partially open position may include more than one position. For example a first partially open position may include a position where the gap 276 is greater than zero inches but a longitudinal axis of the first side lock is not co-linear with a longitudinal axis of the apertures 280, 282, 284 or 285. For example the longitudinal axis of the first side lock may be in a position between the longitudinal axis of apertures 282 and the longitudinal axis of the pair of apertures 280. A second partially open position may include the position of the movable sash 104 relative to frame 102 where the longitudinal axis of first side lock 112 is co-linear with the longitudinal axis of the pair of apertures 282. It is also contemplated that there are other partially opened positions where the longitudinal axis of the first side lock 112 and second side lock 116 are co-linear with pairs of apertures 284 and 285.

When movable sash 104 in the partially open position and main lock 108 in the unlocked position and first side lock 112 and second side lock 116 are in their locked positions, handle 136 is in the first position. To move the first side lock 112 and second side lock 116 from their locked positions to their respective unlocked positions when the movable sash 104 is in the partially open position and the handle 136 is in the first position, a user moves handle 136 from the first position to the second position. This movement of handle 136 moves first side lock 112 and second side lock 116 from their locked positions to their unlocked position respectively without moving main lock 108.

Once a user moves handle 136 from the first position to the second position thereby moving first side lock 112 and second side lock 116 from their locked positions to their respective unlocked positions when the movable sash 104 is in the partially open position a user may move the movable sash 104 to the fully closed position. Once stop 134 releases main lock 108 by contacting a striker plate on second sash 110 main lock 108 is biased to its locked position by biasing member or spring 210. As a result handle 136 is automatically moved from its second position to its first position which moves first side lock 112 and second side lock 116 from their unlocked positions to their respective locked positions.

Figure 7:
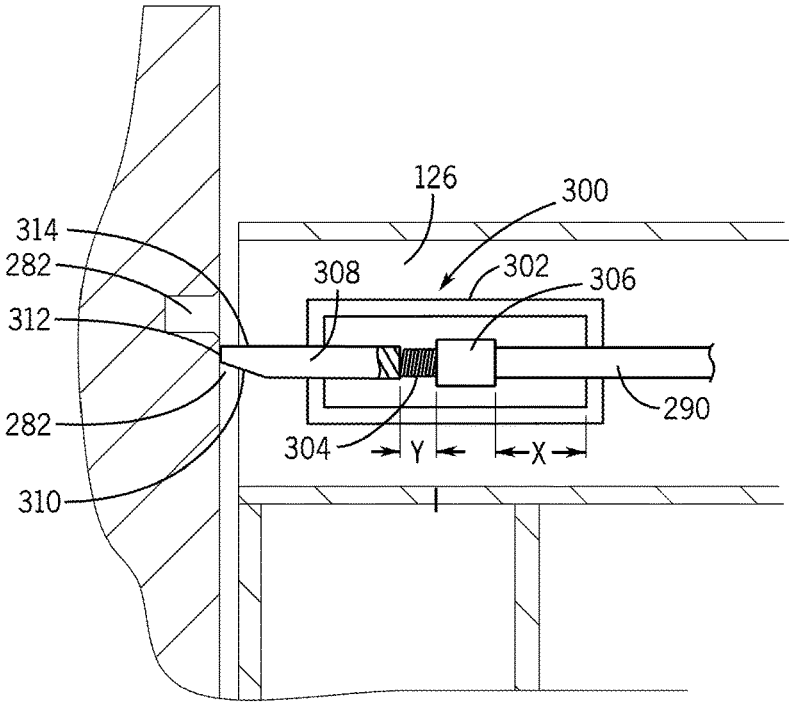
FIG. 7 is a cross-sectional view taken generally along line 7-7 of FIG. 1 of the side lock in a partially engaged position.
Figure 8:
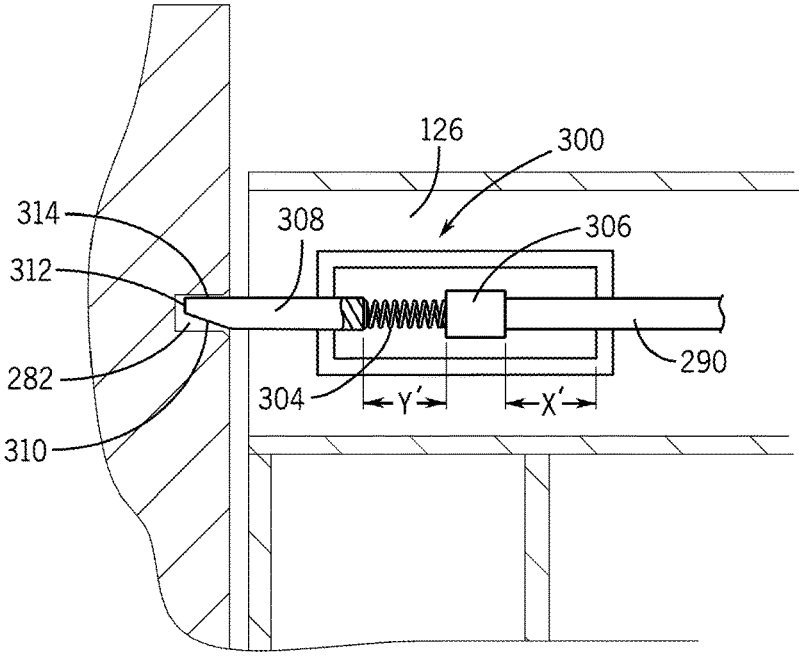
FIG. 8 is a cross-sectional view taken generally along line 7-7 of FIG. 1 of the side lock in an engaged position.

Referring to FIG. 7 and FIG. 8 in one embodiment second side lock 116 includes a first spring bias mechanism 300 having including a housing 302 operatively positioned within first rail 126 proximate second stile 132. In one embodiment extension member 290 is operatively connected to spring bias mechanism 300 through an opening in housing 302. Extension member is connected to a base 306. A biasing member 304 is positioned between base 306 and a bolt 308. When extension member 290 is moved toward jamb 118 of frame 102 base 306 moves within housing 302 toward jamb 118. Movement of base 306 towards jamb 118 will move biasing member 304 and bolt 308 toward jamb 118. In one embodiment biasing member is a compression coil spring. If the tip 312 of bolt 308 is not aligned with aperture 282 as extension member 290 is moved to the locked position then tip 312 will contact a surface of jamb 118 and biasing member 304 will be compressed. The compression of biasing member 304 applies a force to bolt 308 in a direction that biases bolt 308 toward jamb 118.

Referring to FIG. 8 when a user moves movable sash further toward the fully opened position biasing member 304 will bias bolt 308 such that tip 312 will automatically enter and be received within aperture 282 once the longitudinal axis of extension member 290 is aligned with the longitudinal axis of aperture 282.

In one embodiment tip 312 includes a bevel 310 portion and an opposing non beveled portion 314. Beveled portion 310 being closer to second rail 128 than the non-beveled portion 314. In this orientation non-beveled portion 314 resists an intruder attempting to move movable sash 104 toward the fully opened position.

While the description above of the operation of spring bias mechanism 300 was in relation to aperture 282. The operation of spring bias mechanism 300 will operate in a similar manner with apertures 284 and 285. While not illustrated the operation of a spring bias mechanism 300 with first side lock 112 is the same as that of second side lock 116 with the FIGS being a mirror image.

In one embodiment main lock 108 is positioned intermediate first stile 130 and second stile 132. In one embodiment main lock 108 is centrally positioned on first rail 126 between first stile 130 and second stile 132 such that a center of main lock 108 has the same distance between first stile and second stile. In one embodiment a single handle operates main lock 108, first side lock 112 and second side lock 116. In one embodiment first side lock 112 and second side lock 116 are simultaneously moved between their locked and respective unlocked positions by movement of the single handle. In one embodiment the distal free ends of extension members 286 and 290 are positioned within first rail 126 proximate stile 130 and stile 132 respectively when first side lock 112 and second side lock 116 are in their respective unlocked positions.

It is important to note that the apparatus and methods as described herein are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Each of the features described herein may be combined together or used independently with other features described herein in all combinations. For example, elements shown as integrally formed may be constructed of multiple parts or elements and vice versa, the position of elements may be reversed or otherwise varied, and the nature or number of discrete elements or positions may be altered or varied. While one embodiment described herein was a double hung sash window assembly, the three point lock may be used on single sash window assemblies with a fixed second sash or no second sash. In one embodiment a single movable sash may be movable relative to a frame and the main lock, first side lock and second side lock all are moved to a locked position within a portion of the frame.

In one embodiment main lock 108 moves between an unlocked position and a locked position along a first line that is perpendicular to a plane defined by the glazing of movable sash 104. First side lock 112 and second side lock 116 moves between their unlocked and respective locked positions along a second line that is perpendicular to the first line and generally parallel to or coincident with the plane defined by the glazing of movable sash 104.

In one embodiment handle 136 does not move to the second position automatically without an outside force independent of the fenestration assembly 100 when movable sash 104 is in the partially open position and first side lock 112 and second side lock 116 are in their respective locked positions.

Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A fenestration assembly comprising:

a frame, a movable first sash being movable from a fully closed position to a partially open position;

a second sash, a lock assembly including:

a handle movable from a first position to a second position, a main lock movable between a locked position and an unlocked position, the movable first sash being locked to the second sash only in the fully closed position;

a first side lock movable between a first side lock locked position and a first side lock unlocked position locking the movable first sash to the frame in both the fully closed position and partially open position;

wherein the main lock and the first side lock are operatively connected to the handle and the main lock is moved between the locked and the unlocked positions and the first side lock is moved between the first side lock position and the first side lock unlocked position only by movement of the handle between the first position and second position;

wherein the handle includes a handle free end and a pair of pivots, the handle pivoting in relation to the first rail between a first position and a second position, a majority of the handle being closer to the second rail in the first position than when the handle is in the second position.

2. The fenestration assembly of claim 1, wherein the main lock moves between the locked and unlocked positions along a first line that is perpendicular to a plane defined by a glazing of the movable first sash, and wherein the first side lock moves between locked and unlocked positions along a second line that is perpendicular to the first line.

3. The fenestration assembly of claim 1, where the lock assembly includes a second side lock that moves from a second side lock unlocked position to a second side lock locked position to lock the movable first sash to the frame only by movement of the handle.

4. The fenestration assembly of claim 3, wherein the second side lock moves along the second line in a direction opposite the first side lock when the first side lock and the second side lock are moving from locked to respective unlocked positions.

5. The fenestration assembly of claim 1 wherein the movable first sash includes a first rail and second rail spaced from and parallel to the first rail, a first stile and a second stile spaced from and parallel to the first stile, wherein a longitudinal axis of the first rail is perpendicular to a longitudinal axis of the first stile, the handle located on the first rail intermediate the first stile and the second stile.

6. The fenestration assembly of claim 5, wherein the main lock is positioned within the first rail and centrally located between the first stile and the second stile.

7. A fenestration assembly comprising:

a frame, a movable first sash being movable from a fully closed position to a partially open position;

a second sash, a lock assembly including:

a handle movable from a first position to a second position, a main lock movable between a locked position and an unlocked position, the movable first sash being locked to the second sash only in the fully closed position;

a first side lock movable between a first side lock locked position and a first side lock unlocked position locking the movable first sash to the frame in both the fully closed position and partially open position;

wherein the main lock and the first side lock are operatively connected to the handle and the main lock is moved between the locked and the unlocked positions and the first side lock is moved between the first side lock position and the first side lock unlocked position only by movement of the handle between the first position and second position;

wherein the frame includes a first jamb and a second jamb spaced from and parallel to the first jamb, a longitudinal axis of the first jamb being parallel to the longitudinal axis of the first stile, the first jamb including a first aperture configured to receive a free end of the first side lock when the first side lock in the locked position.

8. The fenestration assembly of claim 7, wherein the second jamb includes a second aperture receiving therein a free end of a second side lock when the second side lock is in the second side lock locked position.

9. The lock assembly of claim 8 further wherein the main lock, first side lock and second side lock are in locked positions when the movable first sash is in the fully closed position and the handle is in the first position.

10. The lock assembly of claim 9 wherein the main lock is in unlocked position and the first side lock and second side lock are in respective unlocked positions when the movable first sash is in a partially open position and the handle is in the second position.

11. The lock assembly of claim 10 wherein the main lock is in unlocked position and the first side lock and second side lock are in locked positions when the movable first sash is in a partially open position and the handle is in the first position.

12. The lock assembly of claim 9 further including a side lock spring bias mechanism having a spring operatively connected to the free end of the first side lock, the spring biasing the free end for the first side lock toward the first jamb when the movable first sash is in the partially open position and the first side lock is in the locked position and a longitudinal axis of a region of the first side lock proximate the free end of the first side lock is not co-linear with a longitudinal axis of the first aperture and when the handle is in the first position.

13. A method comprising:

providing a lock assembly to a fenestration assembly located within a frame where the fenestration assembly includes a movable sash movable relative to the frame, the lock assembly including:

a handle movable from a first position to a second position;

a main lock movable along a first line between a locked position and an unlocked position; and a first side lock movable along a second line perpendicular to the first line between a locked position and an unlocked position;

moving the main lock and first side lock from locked positions to respective unlocked positions by moving the handle from the first position to the second position;

moving the movable sash from a fully closed position to a partially open position;

moving the first side lock from the locked position to the unlocked position by moving the handle from the second position to the first position while retaining the main lock in the unlocked position;

wherein the lock assembly includes a second side lock movable along the second line between a locked position and an unlocked position; and further including moving the movable sash from a first partially open position where the distance between a rail of the movable sash and a sill of the frame is a first distance to a second partially open position where the distance between the rail of the movable sash a the sill of the frame is a second distance where the second distance is greater than the first distance, where the frame includes an aperture within a jamb of the frame and the first side lock includes a free end that is received within the aperture when a longitudinal axis of the first side lock is co-linear with a longitudinal axis of the aperture.

14. The method of claim 13, further including moving the second side lock simultaneously with the first side lock in a direction opposite the direction of movement of the first side lock when the handle is being moved between the first and second positions.

15. The method of claim 14, further including automatically moving the main lock, first side lock and second side lock from unlocked positions to locked positions.

16. The method of claim 13 wherein the handle is moved from the second position to the first position when the movable sash is in the first partially open position, and the movable sash is then moved to the second partially open position and the free end of the first side lock being biased into the aperture by a biasing member.

* * * * *